US012733741B2

(12) United States Patent
Liu et al.

(10) Patent No.: US 12,733,741 B2
(45) Date of Patent: Sep. 15, 2026

(54) MECHANISM FOR MOVING A FOOTREST ASSEMBLY BETWEEN FULLY RETRACTED AND FULLY EXTENDED POSITIONS

(71) Applicant: MOTOMOTION CHINA CORPORATION, Changzhou (CN)

(72) Inventors: Chih Hsiung Liu, Benoni (ZA); Heng Zhai, Changzhou (CN)

(73) Assignee: MOTOMOTION CHINA CORPORTION, Changzhou (CN)

( * ) Notice: Subject to any disclaimer, the term of this patent is extended or adjusted under 35 U.S.C. 154(b) by 80 days.

(21) Appl. No.: 19/040,810

(22) Filed: Jan. 29, 2025

(65) Prior Publication Data

US 2026/0215590 A1 Jul. 30, 2026

(51) Int. Cl.
*A47C 7/50* (2006.01)

(52) U.S. Cl.
CPC ..... *A47C 7/5068* (2018.08); *A47C 7/5062* (2018.08); *A47C 7/5066* (2018.08)

(58) Field of Classification Search
CPC ... A47C 7/5062; A47C 7/5066; A47C 7/5068; A47C 7/506
See application file for complete search history.

(56) References Cited

U.S. PATENT DOCUMENTS

| | | | |
|---|---|---|---|
| 7,600,817 | B2 | 10/2009 | Kramer et al. |
| 7,641,277 | B2 | 1/2010 | Lawson et al. |
| 8,328,283 | B2 | 12/2012 | Kramer et al. |
| 8,414,074 | B2 | 4/2013 | Kramer et al. |
| 8,573,687 | B2 | 11/2013 | Lawson et al. |
| 8,696,054 | B2 | 4/2014 | Crum |
| 9,375,089 | B2 | 6/2016 | Lawson et al. |
| 9,386,857 | B2 | 7/2016 | Lawson et al. |
| 9,480,336 | B1 | 11/2016 | Garland et al. |
| 10,092,106 | B2 | 10/2018 | LaPointe et al. |

(Continued)

FOREIGN PATENT DOCUMENTS

| | | |
|---|---|---|
| CN | 110313746 | 10/2019 |
| CN | 110710817 | 1/2020 |

(Continued)

*Primary Examiner* — Alfred J Wujciak
(74) *Attorney, Agent, or Firm* — LAW OFFICES OF STEVEN W. WEINRIEB

(57) ABSTRACT

A mechanism for moving a footrest assembly of a furniture piece between a fully retracted and a fully extended positions, comprises a base, a motor drive mounted upon the base, a footrest assembly operatively connected to the motor drive and adapted to be moved along the base such that the footrest assembly is movable from a first position defined along the base to a second position defined along the base whereby the footrest assembly will be disposed at a first fully retracted position beneath the base when the footrest assembly has been moved to the first position along the base, and will be disposed at a second fully extended position in front of the base when the footrest assembly has been moved to the second position along the base. An inclined plate is fixedly mounted upon the base, and a first pair of rollers are mounted upon the footrest assembly for engaging the inclined plate when the footrest assembly is moved from the first position along the base to the second position along the base such that the footrest assembly is moved from the fully retracted position beneath the base to the fully extended position in front of the base.

10 Claims, 5 Drawing Sheets

(56) References Cited

U.S. PATENT DOCUMENTS

| | | | |
|---|---|---|---|
| 10,143,307 | B2 | 12/2018 | Nelson et al. |
| 10,334,951 | B2 | 7/2019 | Robertson et al. |
| 10,512,332 | B2 | 12/2019 | LaPointe et al. |
| 10,537,178 | B2 | 1/2020 | Marshall et al. |
| 10,568,428 | B2 | 2/2020 | Marshall et al. |
| 10,602,854 | B2 | 3/2020 | Gu et al. |
| 10,750,870 | B2 | 8/2020 | Marshall et al. |
| 10,881,209 | B2 | 1/2021 | Bryant |
| 10,897,995 | B2 | 1/2021 | Crum et al. |
| 11,278,120 | B2 | 3/2022 | Bryant |
| 11,344,123 | B2 | 5/2022 | Crum et al. |
| 11,406,190 | B2 | 8/2022 | Jakubowski |
| 11,679,707 | B2 | 6/2023 | Yu et al. |
| 2022/0087438 | A1 | 3/2022 | Robertson et al. |

FOREIGN PATENT DOCUMENTS

| | | |
|---|---|---|
| CN | 110811198 | 2/2020 |
| CN | 211130387 | 7/2020 |
| CN | 211911062 | 11/2020 |
| CN | 216602231 | 5/2022 |
| CN | 217885523 | 11/2022 |

MECHANISM FOR MOVING A FOOTREST ASSEMBLY BETWEEN FULLY RETRACTED AND FULLY EXTENDED POSITIONS

FIELD OF THE INVENTION

The present invention relates to powered furniture pieces, and more particularly to a new and improved mechanism for moving a footrest assembly of a powered furniture piece, such as, for example, a powered chair, sofa, or love seat.

BACKGROUND OF THE INVENTION

Powered chairs are of course well-known, and are commonly found within residence living rooms, family rooms, dens, offices, and the like. Such powered chairs conventionally comprise various moving parts or components, such as, for example, a backrest assembly, a seat assembly, a footrest assembly, and the like, whereby the powered chair can achieve various different positions or states, such as, for example, an upright position, a TV position, and a reclined position. In conjunction with such positions, the footrest assembly is moved between a fully retracted position and a fully extended position. As is also well-known, conventional footrest assemblies are moved by means of relatively complex linkage systems.

A need therefore exists in the art for a new and improved footrest assembly. Another need exists in the art for a new and improved footrest assembly for a powered chair or similar furniture piece. Still another need exists in the art for a new and improved footrest assembly for a powered chair or similar furniture piece wherein the relatively complex linkage system, for moving the footrest assembly between its fully retracted and fully extended positions, is effectively eliminated. Yet another need exists in the art for a new and improved footrest assembly for a powered chair or similar furniture piece wherein the relatively complex linkage system, for moving the footrest assembly between its fully retracted and fully extended positions, is effectively eliminated and replaced by means of a simplified pivotal link system.

OVERALL OBJECTIVES OF THE INVENTION

A first overall objective of the present invention is to provide a new and improved footrest assembly. Another overall objective of the present invention is to provide a new and improved footrest assembly for a powered chair or similar furniture piece. Still another overall objective of the present invention is to provide a new and improved footrest assembly for a powered chair or similar furniture piece wherein the relatively complex linkage system, for moving the footrest assembly between its fully retracted and fully extended positions, is effectively eliminated. Yet another overall objective of the present invention is to provide a new and improved footrest assembly for a powered chair or similar furniture piece wherein the relatively complex linkage system, for moving the footrest assembly between its fully retracted and fully extended positions, is effectively eliminated and replaced by means of a simplified pivotal link system.

SUMMARY OF THE INVENTION

The foregoing and other objectives are achieved in accordance with the teachings and principles of the present invention by providing a new and improved mechanism for moving a footrest assembly of a powered chair. More particularly, the new and improved mechanism for moving the footrest assembly of a powered chair comprises a base, a power assembly, and a footrest assembly. The power assembly comprises a linear actuator which includes a motor mounted upon a rear cross beam of the base, and a lead screw which is operatively connected to the motor so as to be rotatably driven thereby, the lead screw being disposed within a housing which has its distal end mounted upon a front cross beam of the base. A slide member is slidably disposed upon the housing and is operatively connected to the lead screw such that as the lead screw is rotated by the motor, the slide member will be moved along the housing. The footrest assembly comprises a pair of oppositely disposed L-shaped connecting pieces wherein first ends of the L-shaped connecting pieces are fixedly connected to the slide member while second ends of the L-shaped connecting pieces are fixedly connected to central portions of a movable cross beam. A pair of oppositely disposed Z-shaped sliding pieces are fixedly connected at first end portions thereof to oppositely disposed outer end portions of the movable cross beam while second end portions thereof are adapted to be slidably engaged within U-shaped track portions of a pair of oppositely disposed laterally or transversely spaced longitudinally extending beam members of the base as a result of first pairs of oppositely disposed rollers, rotatably mounted upon the second end portions of the Z-shaped sliding pieces, being disposed within the U-shaped track portions of a pair of oppositely disposed longitudinally extending beam members of the base.

In addition, a pair of oppositely disposed L-shaped footrest lift links are pivotally mounted upon the pair of oppositely disposed Z-shaped sliding pieces, and a second pair of oppositely disposed rollers or wheels are rotatably mounted upon upper ends of the pair of oppositely disposed L-shaped footrest lift links. A tilted or inclined plate is fixedly attached to front end portions of the pair of oppositely disposed laterally or transversely spaced longitudinal beams so that when the entire footrest assembly moves forward, the second pair of oppositely disposed rollers or wheels will engage undersurface portions of the inclined or tilted plate and thereby cause the pair of oppositely disposed, substantially L-shaped footrest lift links to rotate in the counterclockwise direction, around their pivotal connections, thereby moving the footrest assembly from its retracted position, disposed beneath the base, to its extended position in front of the base. Reverse operation of the linear actuator will of course cause the pair of oppositely disposed, substantially L-shaped footrest lift links to rotate in the clockwise direction, around their pivotal connections, thereby moving the footrest assembly from its extended position, in front of the base, to its retracted position disposed beneath the base.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
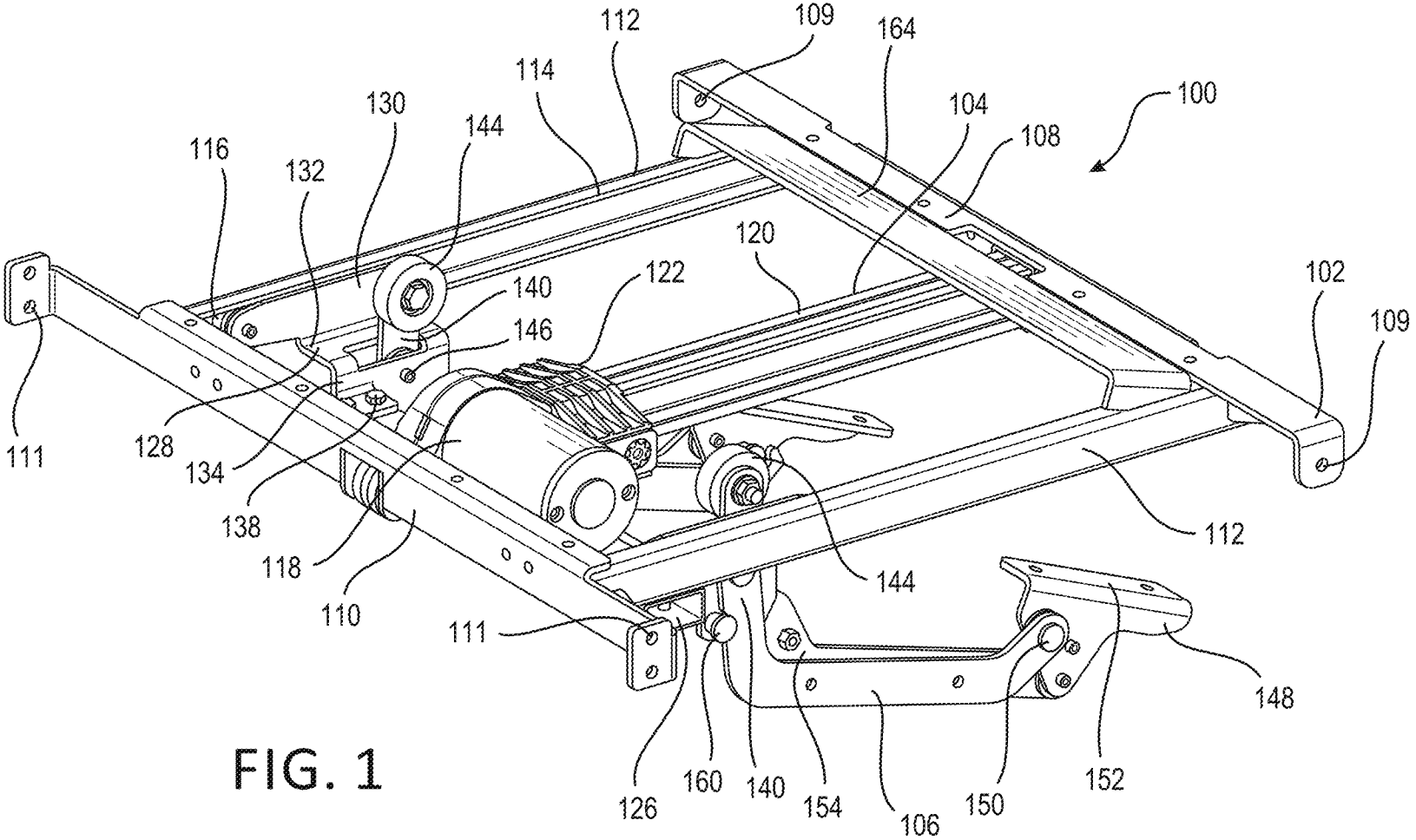
FIG. 1 is a rear, right side perspective view of a new and improved mechanism for moving a footrest assembly of a powered furniture piece, wherein the footrest assembly is shown as being disposed at its retracted position beneath the base of the furniture piece.

Referring now to the drawings, and more particularly to FIGS. 1-5, a new and improved mechanism for moving a footrest, from a retracted position beneath a base portion of the furniture piece to an extended position in front of the base, is disclosed and is generally indicated by the reference character 100. More particularly, it is seen that the mechanism 100 comprises a base 102, a power assembly 104, and a footrest assembly 106. The base 102 effectively comprises a framework which includes a front cross beam 108, a rear cross beam 110, and a pair of oppositely disposed, laterally or transversely spaced longitudinal beams 112 which interconnect the front cross beam 108 and the rear cross beam 110. The front cross beam 108 includes a pair of oppositely disposed holes or apertures 109 by means of which the front cross beam 108 can be mounted upon interior portions of the furniture piece, and in a similar manner, it is seen that the rear cross beam 110 includes oppositely disposed pairs of holes or apertures 111 by means of which the rear cross beam 110 can likewise be mounted upon interior portions of the furniture piece. It is also seen that each one of the pair of oppositely disposed longitudinal beams 112 comprises an inwardly facing U-shaped track 114 within which a first set of wheels 116 are disposed. The power assembly 104 is seen to comprise a linear actuator which includes a motor 118 that is fixedly mounted upon the rear cross beam 110, by means of a suitable clevis-type connector 119, and which is operatively connected to a lead screw, not shown, that is disposed within a housing 120. The front of the housing 120 is fixedly connected to the front cross beam 108, and a slide member 122 is slidably disposed upon the housing 120 and is operatively connected to the lead screw, not shown, such that as the lead screw, not shown, is rotated by means of the motor 118, the slide member 122 will slide along the housing 120.

Figure 2:
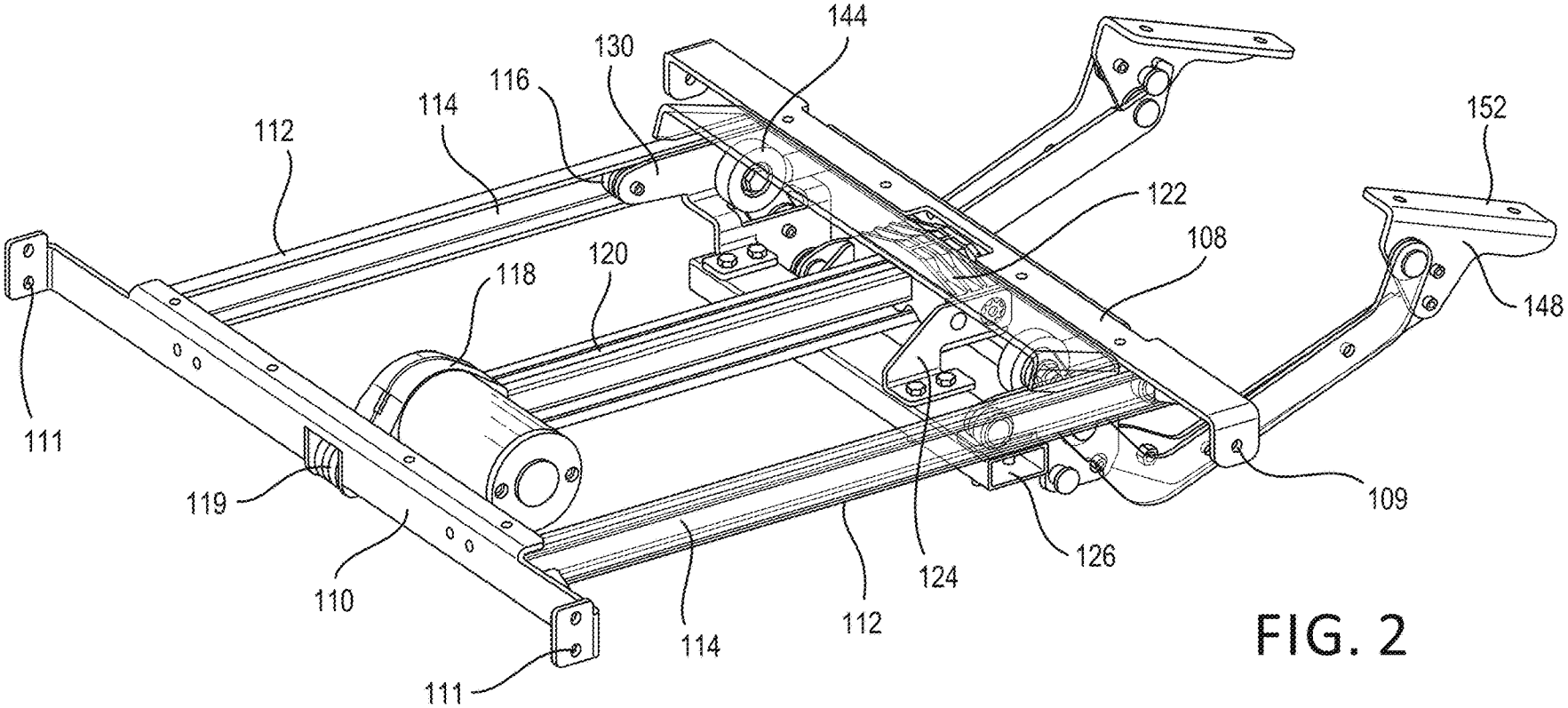
FIG. 2 is a rear, right side perspective view of the new and improved mechanism for moving a footrest assembly of a powered furniture piece, as shown in FIG. 1, wherein the footrest assembly is shown as being disposed at its extended position in front of the base of the furniture piece.

The footrest assembly 106 is seen to comprise a pair of oppositely disposed L-shaped connecting pieces or mounting brackets 124, as can best be seen in FIG. 2, each of which is fixedly connected to an oppositely disposed side of the slide member 122 at one end and to laterally or transversely spaced central portions of a movable cross beam 126, as can also best be seen and appreciated from FIG. 2. In addition, a pair of oppositely disposed Z-shaped sliding pieces 128, the overall structure of which can best be seen and appreciated from FIG. 5 and which comprise upper vertical plates 130, horizontal intermediate plates 132, and lower vertical plates 134, are fixedly connected to opposite ends of the movable cross beam 126 through means of horizontally oriented mounting brackets 136, as can best be seen in FIG. 5, by, for example, bolt fasteners or the like 138 as shown in FIG. 1. The first pair of oppositely disposed wheels/rollers 116 are rotatably mounted upon opposite longitudinal ends of the pair of oppositely disposed upper vertical plates 130, and upper vertically extending portions of a pair of oppositely disposed, substantially L-shaped footrest lift links 140 are seen to extend through slotted portions 142 defined within the pair of Z-shaped sliding pieces 128 at the junctions of the horizontal plates 132 and the lower vertical plates 134. A second pair of oppositely disposed wheels/rollers 144 are rotatably mounted upon upper distal end portions of the vertically extending portions of the pair of oppositely disposed, substantially L-shaped footrest lift links 140, the pair of oppositely disposed, substantially L-shaped footrest lift links 140 being pivotally connected, at first end portions thereof, to the pair of oppositely disposed lower vertical plates 134 of the pair of oppositely disposed Z-shaped sliding pieces 128 as at 146, while second ends of the pair of oppositely disposed, substantially L-shaped footrest lift links 140 are pivotally connected to vertical faces of a pair of oppositely disposed footrest mounting brackets 148 as at 150. It is to be noted that horizontally oriented surfaces 152 of the footrest mounting brackets 148 serve to mount a footrest or ottoman, not shown, thereon.

Figure 3:
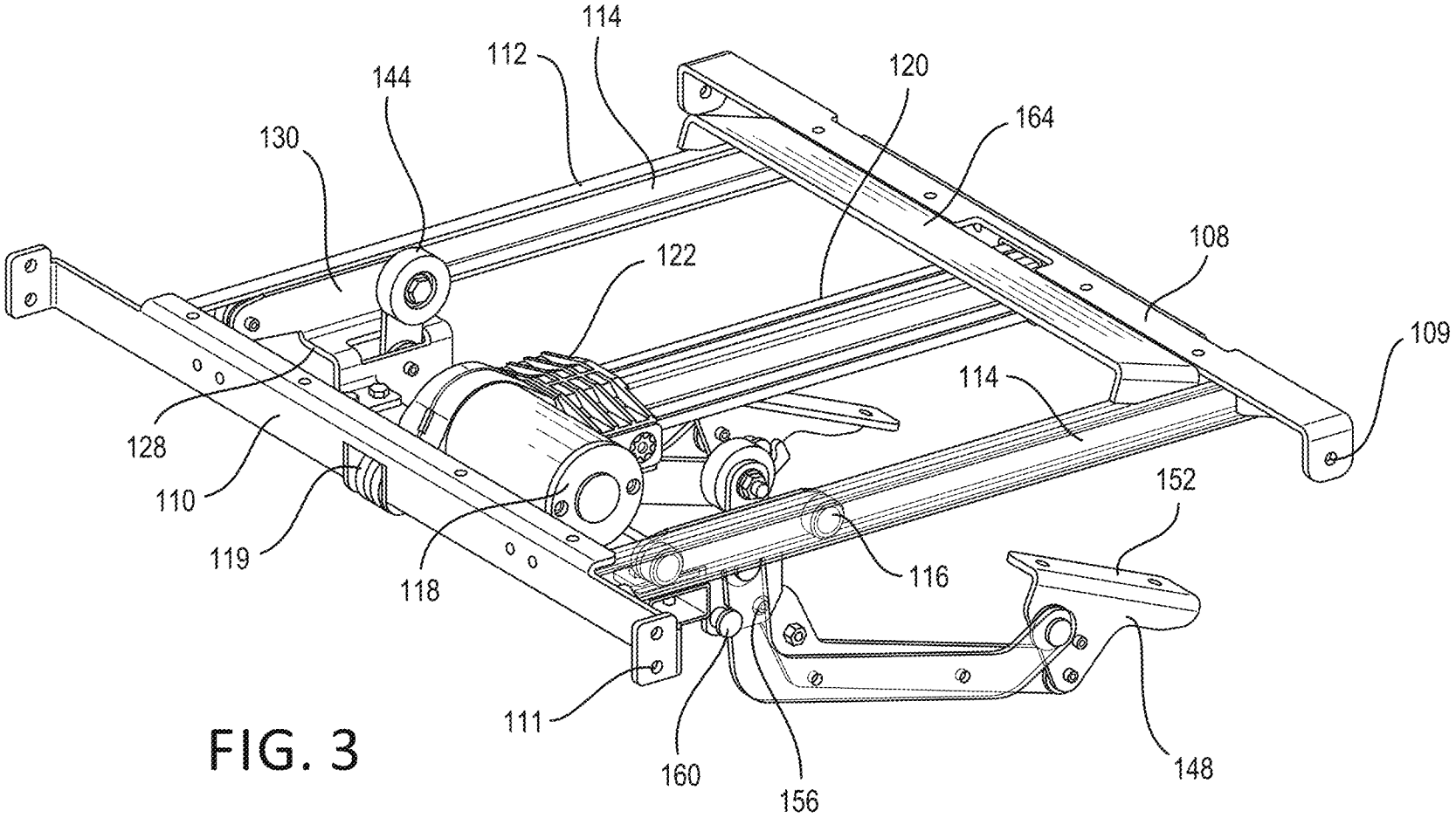
FIG. 3 is a rear, right side perspective view of the new and improved mechanism for moving a footrest assembly of a powered furniture piece, as shown in FIGS. 1 and 2, wherein the footrest assembly is shown as being disposed at its retracted position beneath the base of the furniture piece, and wherein the right longitudinally extending beam member of the base, as well as the right footrest lift link, has been illustrated as being transparent for detail clarity purposes.
Figure 4:
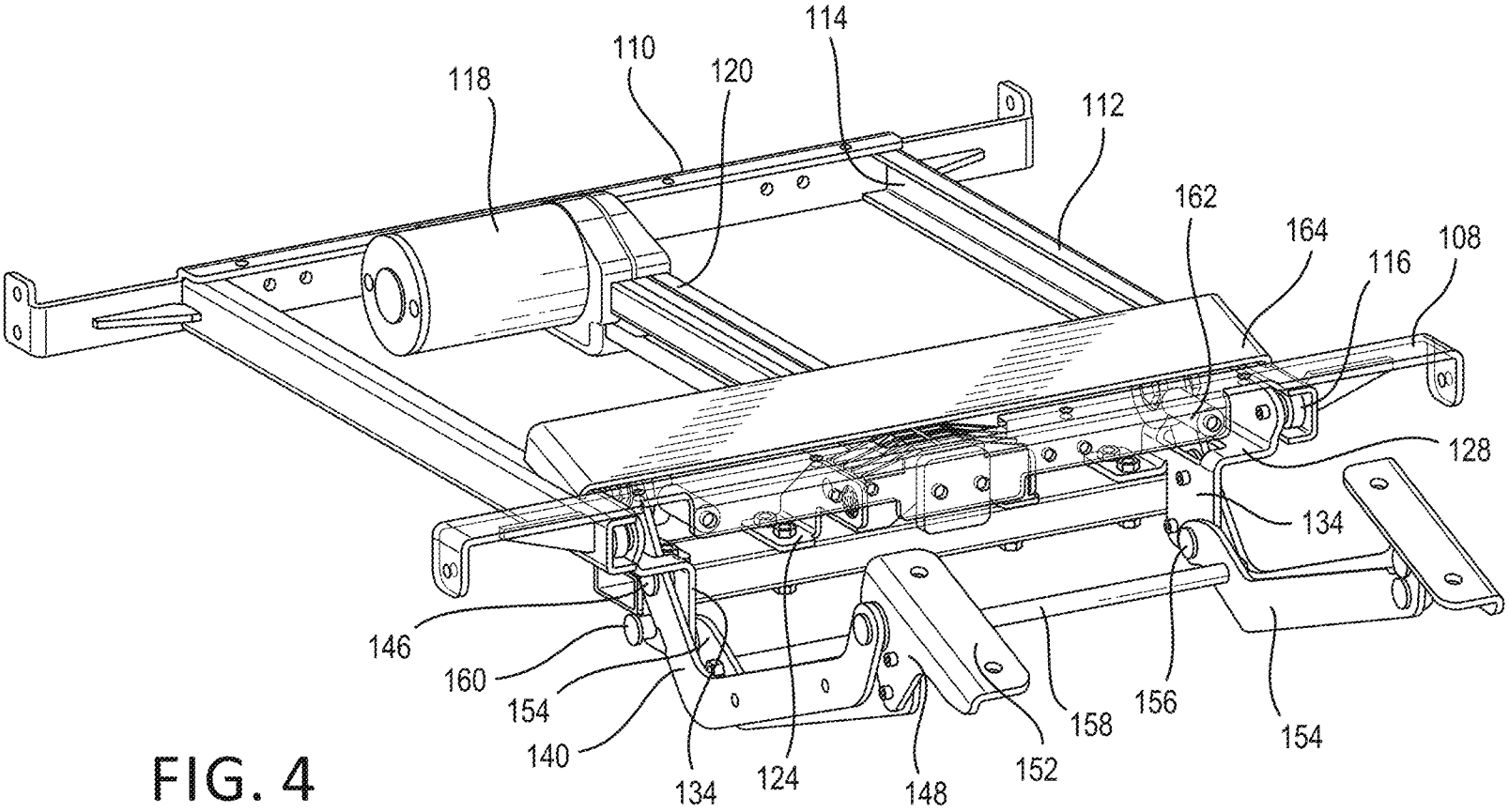
FIG. 4 is a front, right side perspective view of the new and improved mechanism for moving a footrest assembly of a powered furniture piece, as shown in FIGS. 1-3, wherein the footrest assembly is shown as being disposed at its extended position in front of the base of the furniture piece.
Figure 5:
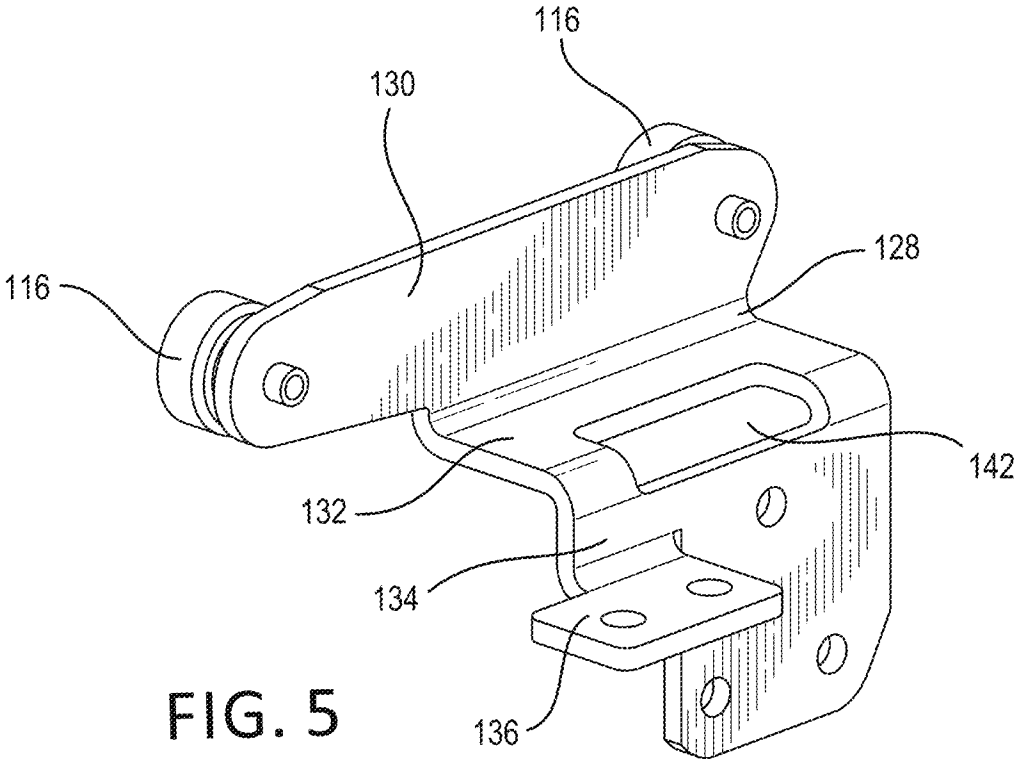
FIG. 5 is an enlarged perspective view of one of the Z-shaped sliding pieces of the footrest assembly.

Continuing further, it is seen that front end portions of a pair of oppositely disposed footrest support links 154 are pivotally connected to the pair of oppositely disposed footrest mounting brackets 148, while rear end portions of the pair of oppositely disposed footrest support links 154 are pivotally connected to the pair of oppositely disposed lower vertical plates 134 of the pair of oppositely disposed Z-shaped sliding pieces 128 as at 156, which can best be seen in FIG. 3. In addition, as can best be seen in FIG. 4, a synchronous bar 158 has its opposite ends fixedly connected to the pair of oppositely disposed footrest support links 154, and a first pair of oppositely disposed limit pins 160 are fixedly mounted upon exterior surface portions of the pair of oppositely disposed lower vertical plates 134 of the pair of oppositely disposed Z-shaped sliding pieces 128, while a second pair of laterally or transversely spaced limit pins 162 are fixedly mounted upon interior surface portions of the front cross beam 108. Accordingly, when the motor 118 is actuated, the slide 122 moves forwardly along the housing 120. In turn, the movable cross beam 126 and the pair of oppositely disposed Z-shaped sliding pieces 128 also move forwardly. In a similar manner, the first pair of oppositely disposed wheels 116 move forwardly within the U-shaped tracks 114 of the pair of oppositely disposed, laterally or transversely spaced longitudinal beams 112, such that, in toto, the entire footrest assembly 106 moves forward. In addition, it is seen that a tilted or inclined plate 164 is fixedly attached to front end portions of the pair of oppositely disposed laterally or transversely spaced longitudinal beams 112, so when the entire footrest assembly 106 moves forward, the second pair of oppositely disposed wheels 144 will engage undersurface portions of the inclined or tilted plate 164 and thereby cause the pair of oppositely disposed, substantially L-shaped footrest lift links 140 to rotate in the counterclockwise direction, around the pivotal connections 146, thereby moving the footrest assembly 106 from its retracted position, disposed beneath the base 102, to the extended position in front of the base 102.

Ultimately, the second pair of laterally or transversely spaced wheels 144 will encounter the second pair of laterally or transversely spaced limit pins 162 which are fixedly mounted upon interior surface portions of the front cross beam 108, such that the footrest assembly 106 is effectively locked at its extended position whereby the same cannot collapse under the weight of a user's feet disposed upon the footrest, not shown, attached to the horizontally oriented surfaces 152 of the footrest mounting brackets 148. Conversely it is to be appreciated that reverse actuation of the motor drive 118 will cause the footrest assembly 106 to move in reverse as a result of the slide member 122 moving rearwardly along the housing 120. Rearward movement of the slide member 122 causes the movable cross beam 126 to move rearwardly which, in turn, cause the pair of oppositely disposed Z-shaped sliding pieces 128 to move rearwardly, such that the rearward movement of the pair of oppositely disposed Z-shaped sliding pieces 128 effectively pull the pair of oppositely disposed, substantially L-shaped footrest lift links 140, the pair of oppositely disposed footrest support links 154, and the pair of oppositely disposed footrest mounting brackets 148, rearwardly. In addition, the second pair of laterally or transversely spaced wheels 144 will now effectively roll along the undersurface portions of the tilted or inclined plate 164, thereby causing the pair of oppositely disposed, substantially L-shaped footrest lift links 140 to rotate in the clockwise direction, around the pivotal connections 146, the pair of oppositely disposed, substantially L-shaped footrest lift links 140 also moving under the influence of gravity, thereby moving the footrest assembly 106 from its extended position, in front of the base 102, to its retracted position beneath the base 102, until the pair of oppositely disposed, substantially L-shaped footrest lift links 140 encounter the first pair of oppositely disposed limit pins 160 whereby the footrest assembly 106 is now disposed at its fully retracted position.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent, is:

1. A mechanism for moving a footrest assembly of a furniture piece between fully retracted and fully extended positions, comprising:

a base;

a motor drive mounted upon said base;

a footrest assembly operatively connected to said motor drive and adapted to be moved along said base such that said footrest assembly is movable from a first position defined along said base to a second position defined along said base whereby said footrest assembly will be disposed at a first fully retracted position beneath said base when said footrest assembly has been moved to said first position along said base, and will be disposed at a second fully extended position in front of said base when said footrest assembly has been moved to said second position along said base;

an inclined plate fixedly mounted upon said base; and a first pair of rollers mounted upon said footrest assembly for engaging said inclined plate when said footrest assembly is moved from said first position along said base to said second position along said base such that said footrest assembly is moved from said fully retracted position beneath said base to said fully extended position in front of said base.

2. The mechanism as set forth in claim 1, wherein:

said base comprises a framework which includes a front cross-beam, a rear cross-beam, and a pair of oppositely disposed, longitudinally extending beams interconnecting said front cross-beam and said rear cross-beam and along which said footrest assembly is moved.

3. The mechanism as set forth in claim 2, wherein said motor drive comprises:

a linear actuator.

4. The mechanism as set forth in claim 3, wherein said linear actuator comprises:

a motor;

a housing having a lead screw disposed therein wherein the lead screw is operatively connected to said motor; and a slide member operatively connected to the lead screw so as to be translatably moved along said housing as said motor drives the lead screw.

5. The mechanism as set forth in claim 4, wherein said footrest assembly comprises:

a movable cross-beam;

a pair of mounting brackets fixedly connecting said slide member and said movable cross-beam together.

6. The mechanism as set forth in claim 5, wherein:

each one of said pair of oppositely disposed, longitudinally extending beams of said base comprises an inwardly facing U-shaped track; and said footrest assembly further comprises a pair of oppositely disposed sliding pieces slidably disposed within said inwardly facing U-shaped tracks defined upon each one of said pair of oppositely disposed, longitudinally extending beams of said base.

7. The mechanism as set forth in claim 6, wherein:

each one of said pair of oppositely disposed sliding pieces slidably disposed within said inwardly facing U-shaped tracks defined upon each one of said pair of oppositely disposed, longitudinally extending beams of said base comprises a second pair of rollers rollingly disposed within said inwardly facing U-shaped tracks defined upon each one of said pair of oppositely disposed, longitudinally extending beams of said base.

8. The mechanism as set forth in claim 6, wherein said footrest assembly further comprises:

a pair of oppositely disposed footrest mounting brackets; and a pair of oppositely disposed L-shaped footrest lift links wherein said pair of oppositely disposed footrest mounting brackets are mounted upon first ends of said pair of oppositely disposed L-shaped footrest lift links, while said first pair of rollers, for engaging said inclined plate, are mounted upon second opposite ends of said pair of oppositely disposed L-shaped footrest lift links.

9. The mechanism as set forth in claim 8, wherein:

each one of said pair of oppositely disposed sliding pieces has a Z-shaped configuration comprising a vertically extending upper plate, a horizontally oriented intermediate plate, and a vertically extending lower plate.

10. The mechanism as set forth in claim 9, wherein:

a slotted portion is defined within each one of said pair of oppositely disposed Z-shaped sliding pieces, at the junction of said vertically extending upper plate and said horizontally oriented intermediate plate for accommodating said second opposite ends of said pair of oppositely disposed L-shaped footrest lift links upon which said first pair of rollers are mounted.

* * * * *